US005924396A

United States Patent [19]

Ochiai et al.

[11] Patent Number: 5,924,396

[45] Date of Patent: Jul. 20, 1999

[54] ENGINE VALVE ACTUATING SYSTEM

[75] Inventors: Katsumi Ochiai; Noriyuki Kurihara, both of Iwata, Japan

[73] Assignee: Yamaha Hatsudoki Kabushiki Kaisha, Iwata, Japan

[21] Appl. No.: 08/946,047

[22] Filed: Oct. 7, 1997

[30] Foreign Application Priority Data

| | | | |
|---|---|---|---|
| Oct. 7, 1996 | [JP] | Japan | 8-266071 |
| Oct. 21, 1996 | [JP] | Japan | 8-277692 |
| Oct. 7, 1997 | [JP] | Japan | 8-266080 |

[51] Int. Cl.[6] ..... F01L 13/00

[52] U.S. Cl. ..... 123/90.16; 123/90.39

[58] Field of Search ..... 123/90.15, 90.16, 123/90.17, 90.22, 90.39, 90.44

[56] References Cited

U.S. PATENT DOCUMENTS

| | | | |
|---|---|---|---|
| 4,887,563 | 12/1989 | Ishida et al. | 123/90.16 |
| 5,239,952 | 8/1993 | Morita | 123/90.16 |
| 5,301,636 | 4/1994 | Nakamura | 123/90.16 |
| 5,529,032 | 6/1996 | Oikawa et al. | 123/90.16 |
| 5,558,060 | 9/1996 | Horie et al. | 123/90.16 |
| 5,622,145 | 4/1997 | Hara | 123/90.16 |
| 5,651,336 | 7/1997 | Rygiel et al. | 123/90.16 |

FOREIGN PATENT DOCUMENTS

| | | |
|---|---|---|
| 2535390 | 5/1984 | France . |
| 3613945 | 10/1986 | Germany . |
| 3814835 | 12/1988 | Germany . |
| 196 42 059 | 4/1997 | Germany . |
| 08074533 | 3/1996 | Japan . |
| 2254109 | 9/1992 | United Kingdom . |

OTHER PUBLICATIONS

Patent Abstracts of Japan, vol. 015, No. 279 (M–1136), Jul. 16, 1991 & JP 03 096605 A.

Patent Abstracts of Japan, vol. 010, No. 385 (M–548), Dec. 24, 1986 & JP 61 175206 A.

*Primary Examiner*—Weilun Lo

*Attorney, Agent, or Firm*—Knobbe, Martens, Olson & Bear LLP

[57] ABSTRACT

A number of embodiments of variable valve actuating systems wherein the valve is operated selectively by either first or second rocker arms both of which are supported for pivotal movement on the same rocker arm shaft but which are operated by different cams and have different lifts. Only one of the rocker arms directly operates the valve. The lift is changed by selectively coupling the rocker arms for simultaneous operation. A number of variations in locations and valve actuation are disclosed as well as a variable induction system that cooperates with the variable valve actuation to improve the engine performance over a wider range of speeds and loads.

26 Claims, 18 Drawing Sheets

ENGINE VALVE ACTUATING SYSTEM

BACKGROUND OF THE INVENTION

This invention relates to an engine valve actuating system and more particularly to an improved arrangement for achieving variable valve actuation (timing and/or lift0 in the operation of an engine valve.

As is well-known, many factors in an internal combustion engine represent a design compromise. Generally, the compromise is between achieving good low-speed performance and economy and high output and high power. There has been proposed a wide variety of devices, however, so as to permit the engine characteristics to be adjusted during its running, so as to obtain improved performance across the entire speed and load range. One of these features is variable valve actuation which includes both changing the valve timing and/or the valve lift. Obviously, these present substantial challenges to the engineer considering that the adjustment must be made when the engine is running.

A wide variety of mechanisms have been proposed for achieving either or both of the variable valve timing and variable valve lift. For the most part, however, they are fairly complex and add significantly to the complexity of the valve train.

It is, therefore, a principal object of this invention to provide an improved variable valve actuating mechanism that is relatively simple in construction and which lends itself to incorporation in multi-valve engines.

It is still further object of this invention to provide an improved valve operating mechanism for an engine that can achieve variable valve operation during engine running.

SUMMARY OF THE INVENTION

This invention is adapted to be embodied in the valve actuating mechanism for operating a single poppet valve of an engine through cooperation with the stem thereof. The valve operating mechanism is comprised of a single cam shaft having a pair of adjacent cams. A pair of adjacent, pivotally supported rocker arms, each cooperate with a respective one of the cams. A first of the rocker arms has an operating portion for direct cooperation with the valve stem for operating the valve. Means provide a selective coupling of the second rocker arm to the first rocker arm for effecting actuation of the valve through the first rocker arm. Thus, by providing different characteristics of the cam and rocker arms, varying lift and/or duration can be achieved.

DETAILED DESCRIPTION OF THE PREFERRED EMBODIMENTS

Figure 1:
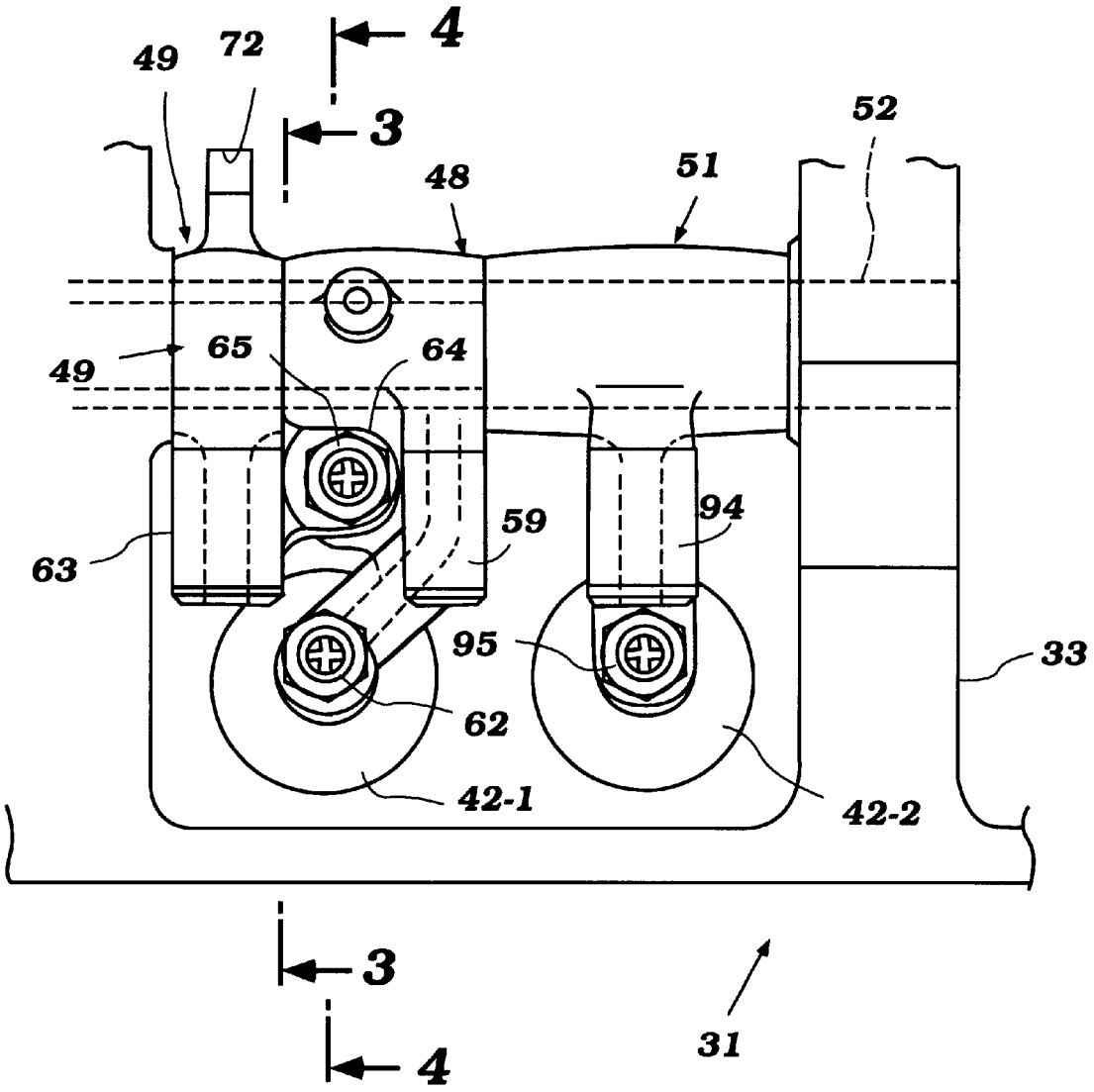
FIG. 1 is a top plan view looking at the valve actuating mechanism associated with a single cylinder of an internal combustion engine constructed in accordance with a first embodiment of the invention, with the cam cover for the engine removed.

Referring now in detail to the drawings and initially to the embodiment of FIGS. 1—13, a portion of a cylinder head assembly of an internal combustion engine is illustrated and is identified generally by the reference numeral 31. Only a portion of the engine is illustrated and specifically the cylinder head thereof because the invention deals, as aforenoted, with a valve actuating mechanism for engines. Therefore, when any details of the construction of the engine are not illustrated, they may be considered to be conventional. Those skilled in the art will be able to determine from the following description how the invention can be utilized with a wide variety of engines.

In all of the embodiments illustrated, the depicted engine and cylinder head 31 are of the four valve cylinder type. This is because the invention has particular utility with multi-valve engines, for reasons which will become apparent. However, the invention can be utilized with engines having any number of valves including only two valves per cylinder or more than two valves in any number.

The cylinder head assembly 31 includes a main cylinder head member 32 which has an upper surface which carries a bearing and cam carrier 33 and which is closed by a cam cover 34.

Figure 3:
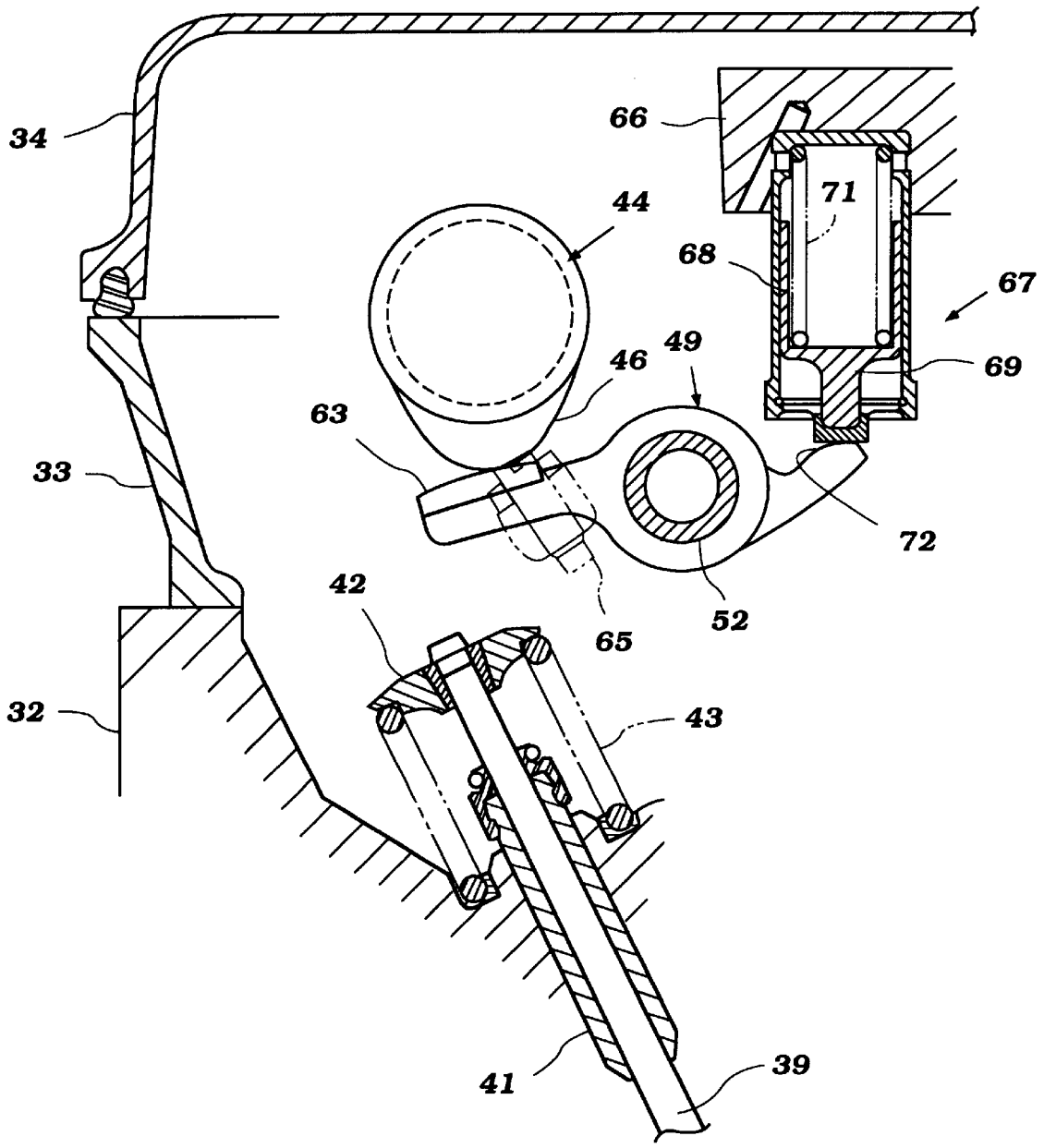
FIG. 3 is a cross-sectional view taken along the line 3—3 of FIG. 1 and illustrates one of the rocker arms and its association with the cam shaft.
Figure 4:
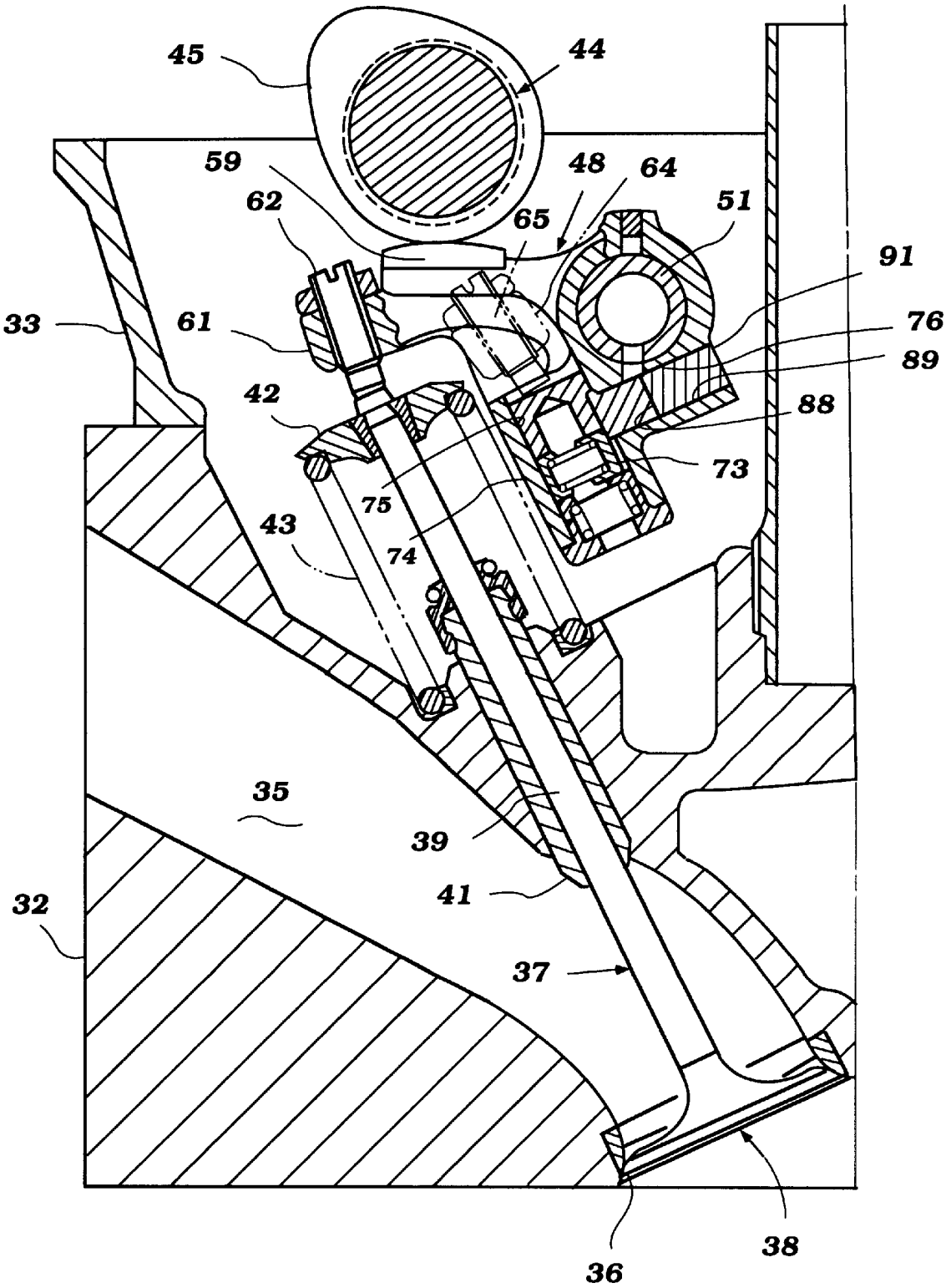
FIG. 4 is a cross-sectional view taken along the line 4—4 of FIG. 1 and shows the valve in its closed position.
Figure 5:
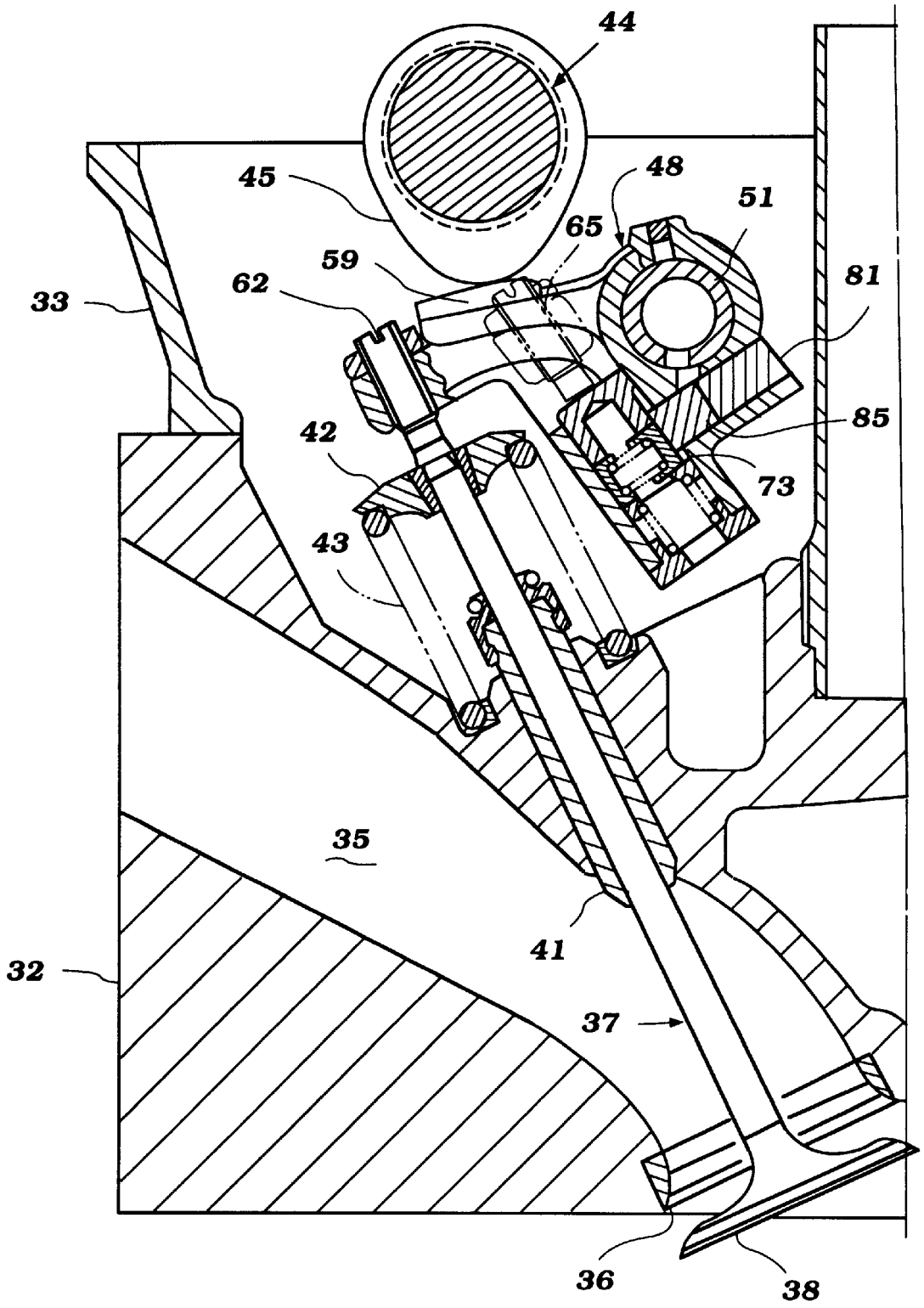
FIG. 5 is a cross-sectional view, in part similar to FIG. 4, and shows the valve in its open position when opened by the first rocker arm.

As best seen in FIGS. 3–5, each cylinder of the engine is served by a pair of intake passages 35 that terminate in valve seats 36 which are valved by poppet-type intake valves, indicated generally by the reference numeral 37. These valves 37 have head portions 38 that cooperate with the valve seats 36 and stem portions 39 that are slidably supported in valve guides 41 affixed to the cylinder head member 32.

At their upper ends, keeper retainer assemblies 42 retain spring assemblies 43 that act between the keeper retainer assemblies 42 and the cylinder head for biasing the valves 37 to their closed positions, as is well-known in this art.

Figure 2:
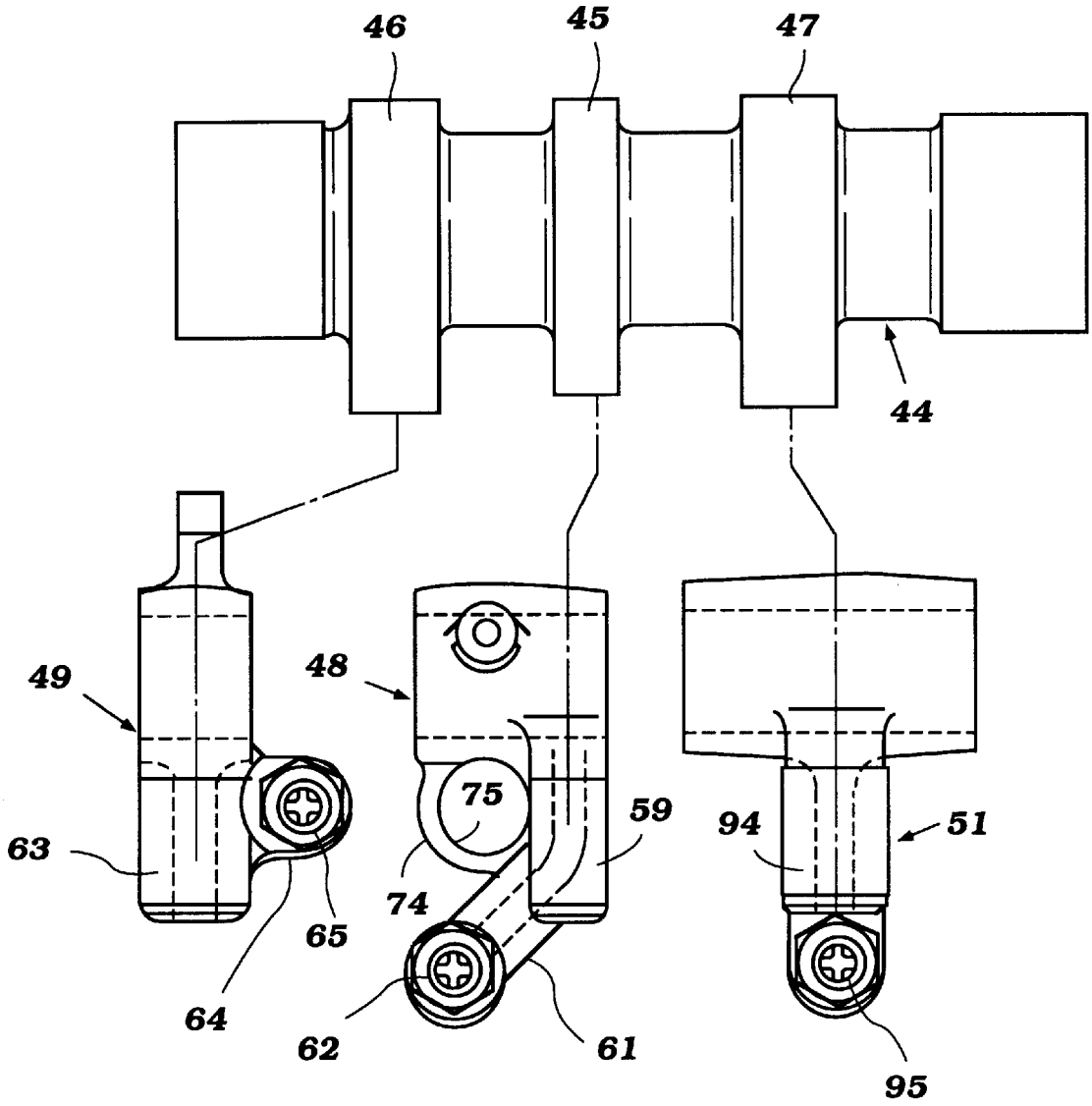
FIG. 2 is an exploded view showing the same components illustrated in FIG. 1 but illustrating only the cam shaft and the rocker arms associated therewith.

Referring now primarily to FIGS. 1 and 2, a cam shaft, indicated generally by the reference numeral 44, is journaled in the cam carrier 43 by bearing surfaces formed by it and bearing caps which are not illustrated. The cam shaft 44 has three lobes comprised of a first, center lobe 45, a second lobe 46, and a third lobe 47. Associated with these lobes 45–47 are first, second and third rocker arms, indicated generally by the reference numerals 48, 49 and 51. These rocker arms 48, 49 and 51 are all journaled on a common rocker arm shaft 52 that is carried by the cam carrier member 33 in any known manner.

As may be best seen from FIG. 1, the cam lobes 45 and 46 and their cooperating rocker arms 48 and 49 are associated with one of the valves 37, the keeper retainer of which is indicated by the reference numeral 42-1. The remaining cam lobe 47 and rocker arm 51 are associated with and operate the remaining intake valve 37 and their association is indicated by the reference numeral 42-2, which identifies the keeper retainer of this remaining valve.

The first rocker arm 48 is a rocker arm which, under all conditions, operates the associated intake valve having a retainer 42-1. This rocker arm 48 has a follower portion 53 which is engaged with the cam lobe 45 and which is actuated by it. An actuating portion 61 extends integrally outwardly from the area adjacent the cam follower 59 and carries an adjusting screw 62 at its outer end which cooperates with the tip of the stem 39 of the associated valve. Thus, this rocker arm generally operates as a conventional rocker arm for the valve actuation during such time as the second rocker arm 49 is not coupled to it. This coupling method will be described later.

Referring now primarily to FIGS. 1–3, the second rocker arm 49 and its cooperation with the cam lobe 46 will be described. The rocker arm 49 has an outwardly extending arm which forms an integral follower 63 that is engaged by the cam lobe 46. At this point, it should be noted that the cam lobe 46 is of a larger lift and larger diameter than that of the cam lobe 45. In addition to providing a different lift, this cam lobe 46 may also be configured to provide slightly different timing through its cooperation with the first rocker arm 48.

Adjacent the follower surface 63, the rocker arm 49 is provided with a protrusion 64 that receives an adjusting screw 65. This adjusting screw 65 operates in conjunction with a coupling mechanism to, at times, control the operation of the rocker arm 48. That mechanism will be described very shortly.

In order to maintain the rocker follower surface 63 in engagement with the cam lobe 46, a biasing arrangement shown in FIG. 3 is provided. As seen in this Figure, a spring carrier 66 is affixed to the cam carrier 33 in a known manner. The spring carrier 66 is provided with a plurality of pockets, one for each rocker arm 49. A spring arrangement, indicated by the reference numeral 67, is supported in each of these pockets.

The spring arrangement includes an outer cylinder member 68 which defines a bore in which a sliding biasing member 69 is provided. The sliding biasing member 69 is biased by a coil compression spring 71 into engagement with a further follower surface 72 formed on a portion of the rocker arm 49 that extends in somewhat diametrical opposition to the portion that forms the follower surface 63. Thus, the spring 71 acting through the biasing member 69 and rocker arm surface 72 will maintain the rocker arm follower 63 in engagement with the cam lobe 46.

The mechanism for selectively coupling the rocker arm 49 to operate the rocker arm 48 will now be described by particular reference to FIGS. 4–13. FIGS. 4 and 5 show this coupling mechanism, which is indicated generally by the reference numeral 73, in the disengaged condition so that the rocker arm 48 operates without any control or interference from the rocker arm 43. Under this condition, the cam lobe 45 and rocker arm 48 control the degree of maximum opening and timing of opening of the valve 37 with the fully-opened position being shown in FIG. 5.

The rocker arm 48 has a boss portion 74 that is formed adjacent its follower surface 59 but below it. A cylindrical bore 75 is formed in this boss 74. A coupling plunger member, having a configuration shown in FIGS. 8–10 and indicated generally by the reference numeral 76, is slidably supported within this bore. This coupling plunger member 76 has a head or top portion 77 which is positioned to be and is engaged during the running of the engine by the screw 65.

Figure 11:
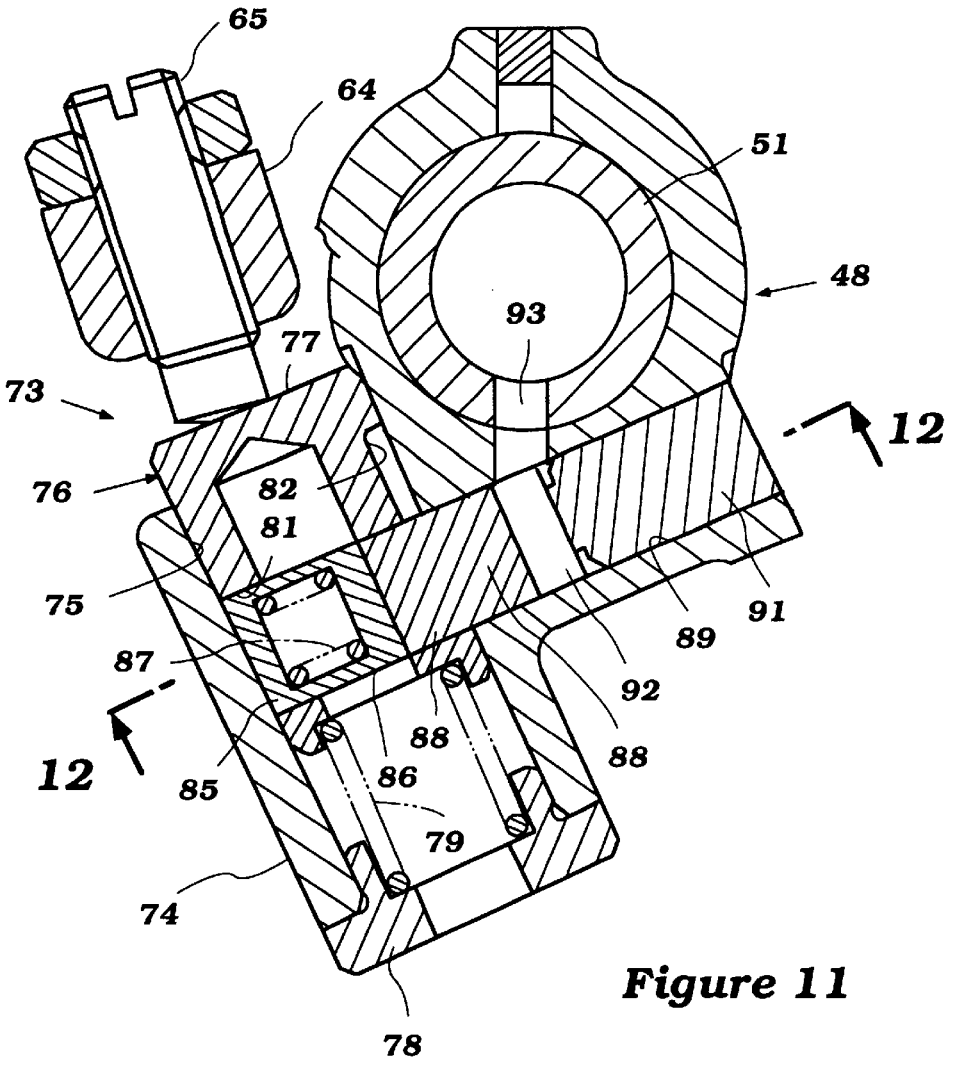
FIG. 11 is a cross-sectional view taken along the same plane as FIG. 6 and shows the arrangement when the second rocker arm is coupled to the first rocker arm and is effective to operate the first rocker arm and the valve therethrough.

As may be best seen in FIG. 11, the lower end of the bore 74 is partially closed by a cap 78 which forms an engagement for a biasing spring 79 that acts on the lower end of the coupling plunger member 76. This spring 79 keeps the coupling plunger member 76 and specifically its surface 77 in constant engagement with the adjusting screw 65. It should be apparent, however, that if desired, some clearance may be maintained in this gap depending upon how the valve operation is to be accomplished. Also in some views the position of the plunger member 76 in the bore may not be the true position depending upon the lift characteristics of the respective cams 45 and 46 and specifically that of their lobes.

The coupling plunger member 76 is formed with a bore 81 that extends from a flat surface 82 formed in a side thereof by a machined recess 83. Received within the bore 81 is a return spring arrangement that is comprised of a pair of end caps 85 and 86 that are urged apart by a coil compression spring 87.

In the uncoupled state when only the cam 45 is operating the valve 37, this compression spring 87 causes the retaining member 83 to be urged to a position where a flat surface of it is coextensive with the surface 82. Under this condition the surface 82 is engaged by a slidable locking member 88.

The locking member 88 is slidably supported within a bore 89 that extends through the rocker arm 48 below its journal on the rocker arm shaft 51. The outer end of this bore 89 is closed by a closure plug 91 and in the uncoupled state, the locking member 88 is abuttingly engaged with this closure plug 91.

Figure 6:
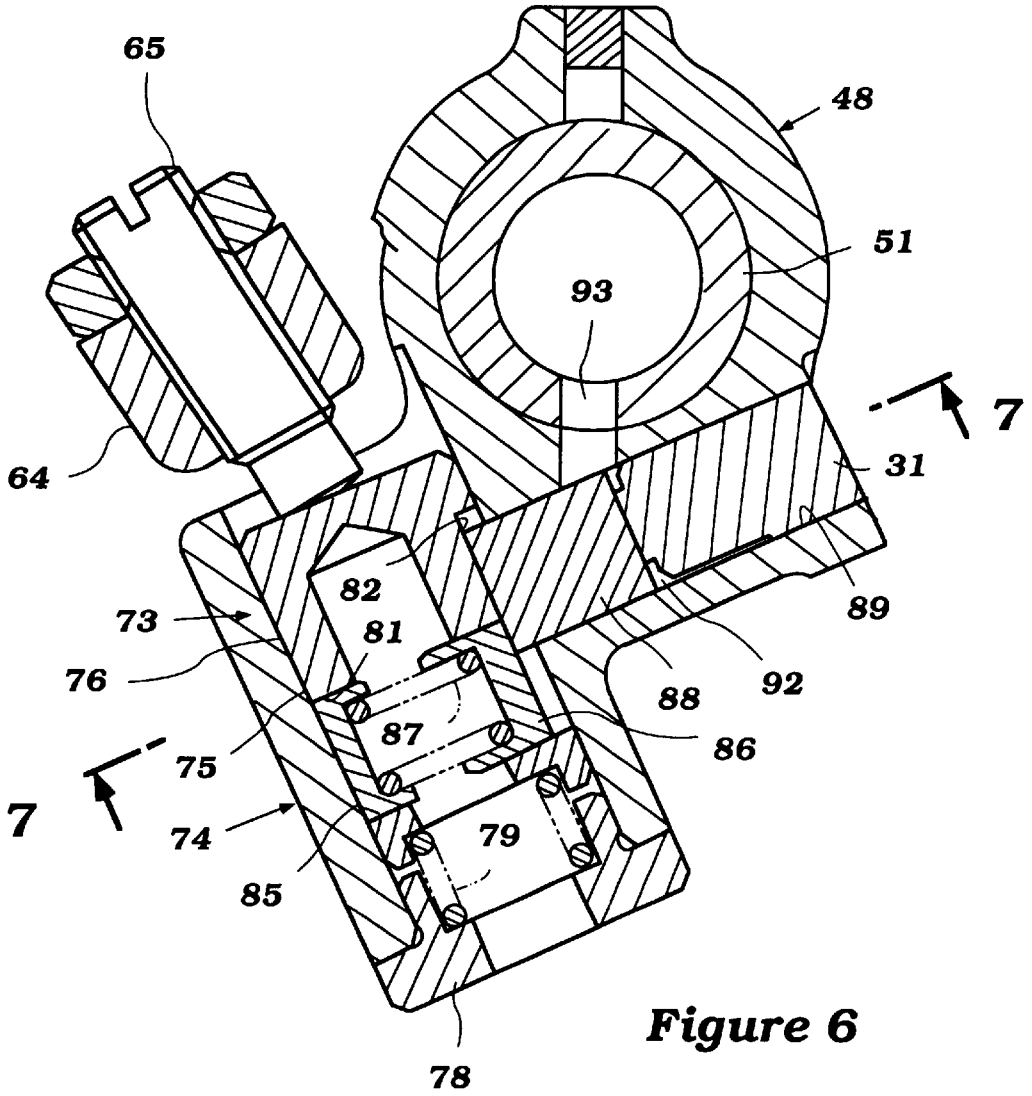
FIG. 6 is an enlarged cross-sectional view taken along the same plane as FIGS. 4 and 5, and shows the same condition in FIG. 4, i.e., with the valve closed.
Figure 7:
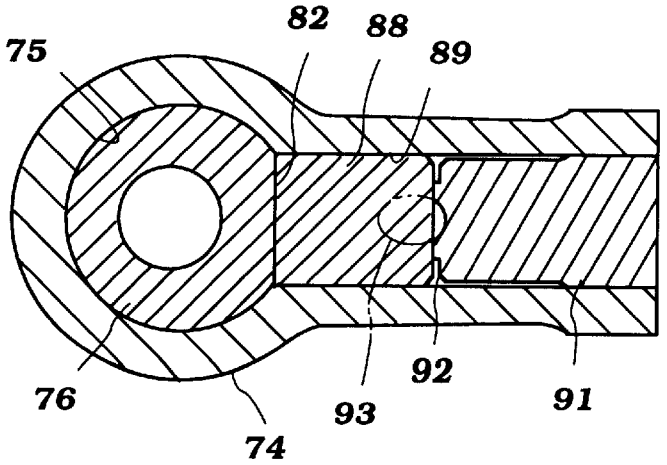
FIG. 7 is a cross-sectional view taken along the line 7—7 of FIG. 6.
Figure 8:
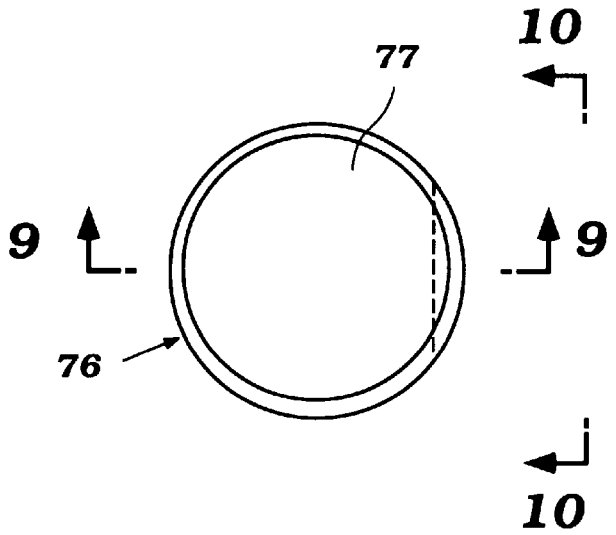
FIG. 8 is a top plan view showing one of the elements (the plunger) of the coupling mechanism which is effective to either couple or uncouple the second rocker arm from its operating relationship with the first rocker arm.
Figure 9:
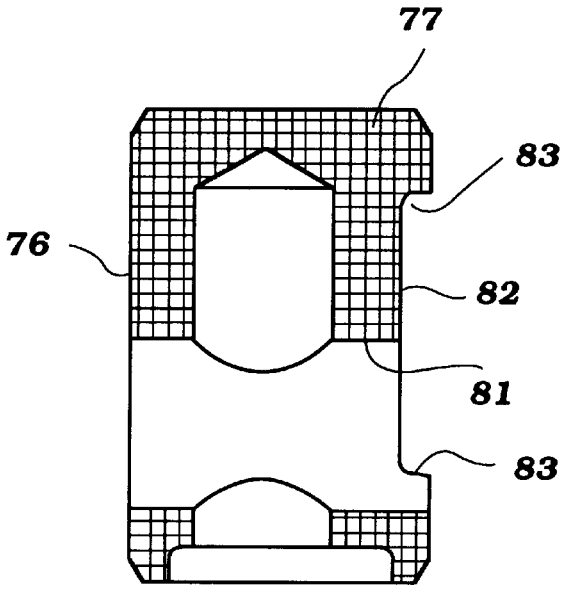
FIG. 9 is a cross-sectional view taken along the line 9—9 of FIG. 8. This figure is shaded so that the shape can be more easily recognized.
Figure 10:
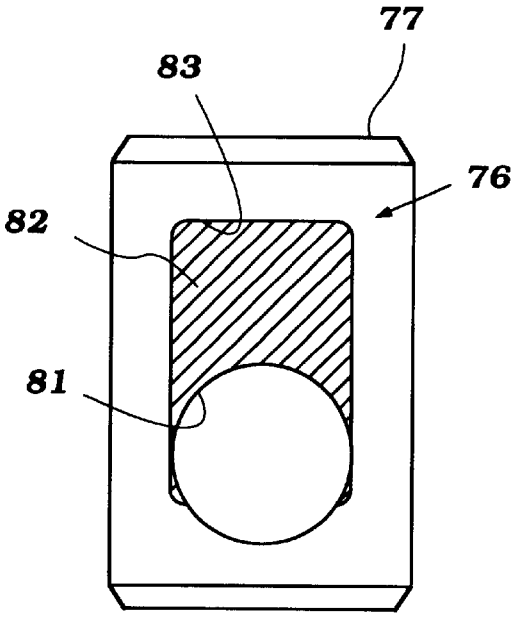
FIG. 10 is a side-elevational view looking in the direction of the arrow 10—10 in FIG. 8. This figure is also shaded so that the shape can be more easily recognized.

The cooperation of the locking member 88 with the side of the surface 82 will permit reciprocation of the coupling plunger member 76 in the bore 75 between the position shown in FIG. 4 which represents the closed condition and the position shown in FIG. 6 which shows the condition when the intake valve 37 is opened to its maximum lift during the time when the cam lobe 45 is operating the rocker arm 48 so as to control the timing and lift of the valve 37. Rotation of the plunger member 76 in the bore 75 is, however, precluded by this coaction.

When the cam lobe 46 operates the rocker arm 49 to begin its lift, then the coupling plunger member 76 will be driven downwardly in the bore 75 as shown in FIG. 6. Under this condition, no additional movement of the rocker arm 48 will occur and thus there is lost motion under this operation.

It should be noted that in the retracted position of the locking member 88, a gap 92 is provided between it and the end closure 91. This gap communicates with an oil control passage 93 that extends through the rocker arm shaft 51 and rocker arm 48. The rocker arm shaft 51 is hollow and hydraulic fluid pressure may be exerted selectively through this passage 73 to the area 92 in accordance with a desired control strategy. One such strategy will be described later by reference to the embodiment of FIG. 14.

Figure 12:
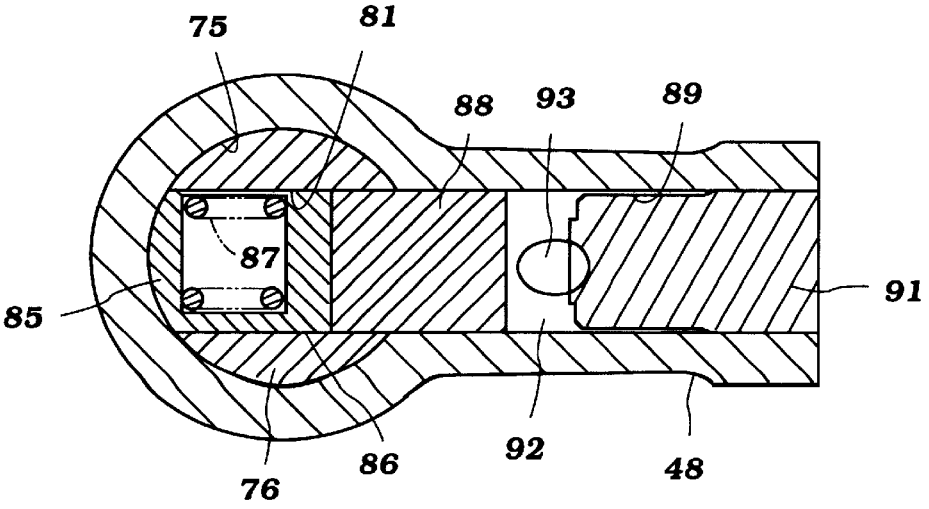
FIG. 12 is a cross-sectional view taken along the line 12—12 of FIG. 11.
Figure 13:
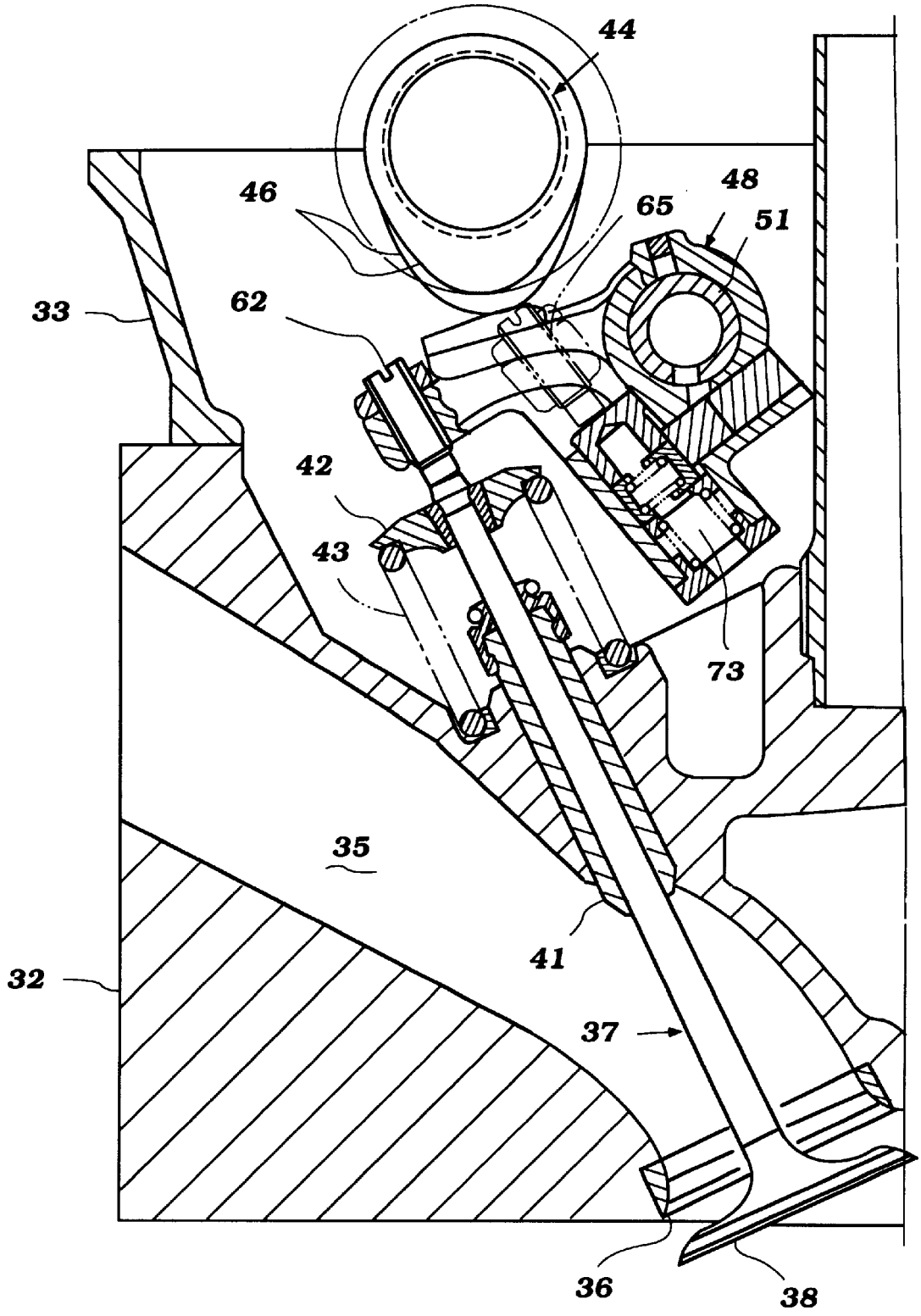
FIG. 13 is a cross-sectional view, in part similar to FIGS. 4 and 5, but shows the valve in its fully opened position when operated by the second rocker arm acting through the first rocker arm.

When this passage 93 is pressurized, as shown in FIGS. 11 and 12, the locking plunger 83, when it registers with the bore 81, will act on the retainer member 86 and force it inwardly and compress the spring 87. At this time, the rocker arms 48 and 49 will be coupled together and the rocker arm 49, because of its greater lift and timing, will actually control the opening degree of the valve so as to provide a greater lift under this coupled condition as clearly shown in FIG. 13. By comparing FIG. 13 with FIG. 5, this greater lift condition can be readily appreciated.

When the hydraulic pressure in the passage 93 and area 92 is relieved, the spring 87 will urge the locking plunger 88 back to its disengaged position as shown in FIGS. 4–7.

Referring back to FIGS. 1 and 2, it will be seen that the rocker arm 51 and cam lobe 47 that operate the remaining intake valve which does not have its lift varied in this embodiment. The rocker arm 51 has a follower surface 94 that is engaged by the cam lobe 47. An adjusting screw 95 carried at the tip of this rocker arm cooperates with the stem of this valve to operate it in a normal manner. Varying types of lift arrangements may be employed and different lift ratios and/or valve timing between the non-variable actuated valve and the variable actuated valve. That is the lift and/or timing of the valve operated by the cam 47 may be the same as that provided by either of the cams 45 or 46 associated with the other valve or different from either of them.

Figure 14:
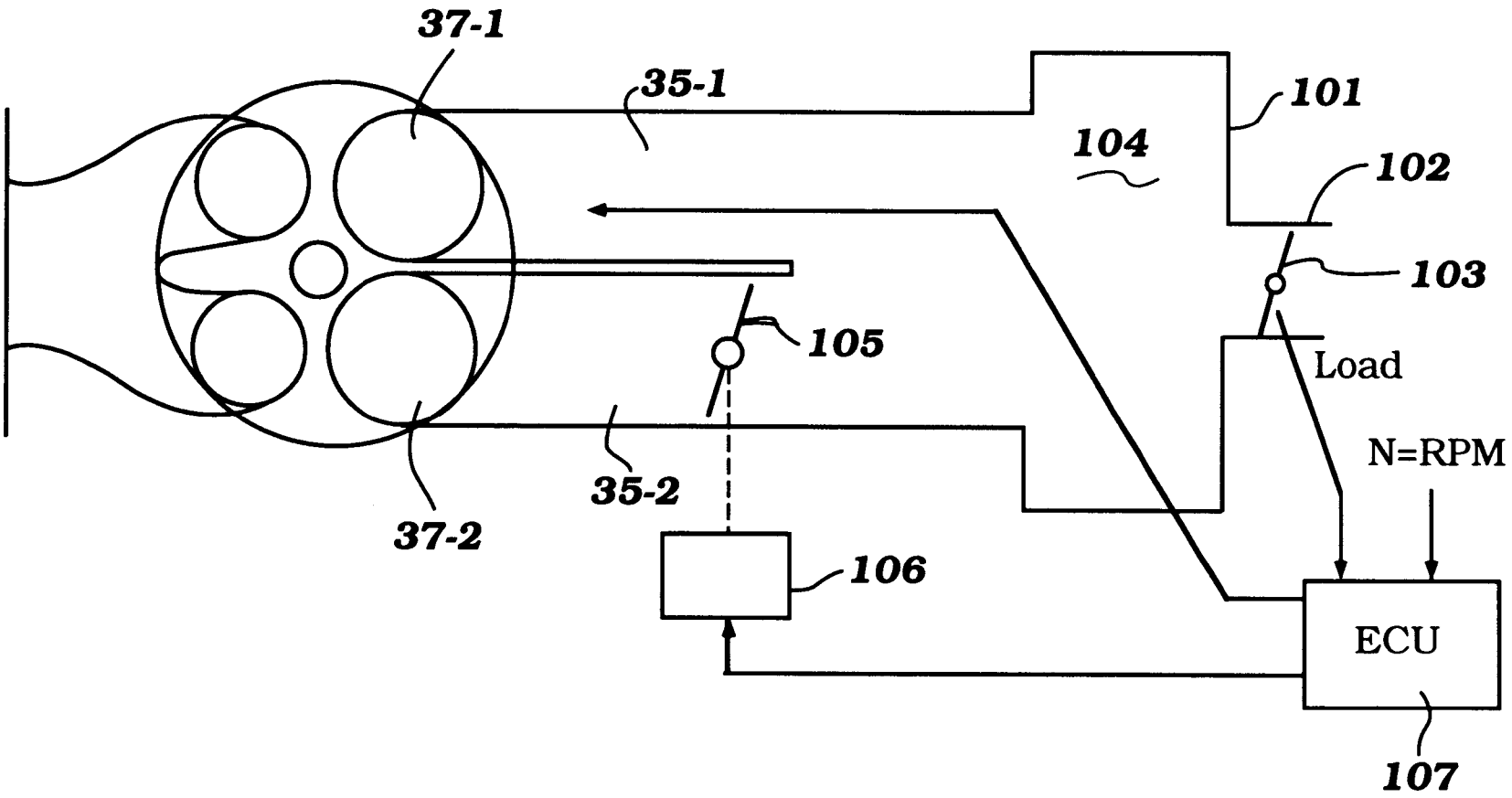
FIG. 14 is a partially schematic view showing an induction system for the engine and an ancillary intake control system that may be utilized in conjunction with the various valve operating embodiments disclosed herein.

FIG. 14 is a view that shows one way in which this mechanism may operate. This view shows the induction system schematically and it now will be described by reference to that Figure. In this Figure, the normally or non-variably actuated valve is indicated by the reference numeral 37-2, while the variably actuated valve is indicated by the reference numeral 37-1. The intake passages 35 associated therewith have also been indicated by the same suffixes, i.e., 35-2 and 35-1.

In accordance with this embodiment, an air inlet device, indicated by the reference numeral 101, draws atmospheric air through an inlet opening 102 in which a manually actuated throttle control valve 103 is positioned. The air inlet device 101 forms a plenum chamber 104 that communicates with the runners 35-1 and 35-2 of each cylinder.

A control valve 105 is provided in the runner 35-2 and is operated by a servo motor 106 under the control of an ECU, indicated generally by the reference numeral 107.

In this embodiment, the intake valve 37-1 and its operation is adjusted to optimize primarily the low and mid-range performance of the engine. Thus, the cam lobe 45 and rocker arm 48 can be tailored for optimum performance under low-speed and low-mid range running. The cam lobe 46 and rocker arm 49 are coupled for a higher range of operation and may provide a substantially greater lift so as to improve the performance under higher speeds and loads.

Thus, the control strategy for the ECU is to sense throttle position or load and engine speed and be mapped so as to activate the servo motor 106 and maintain the throttle valve 105 in a closed position during low-speed and low-to-medium mid-range running.

As the speed and load increase, however, then the ECU effects opening of the control valve 105 by the servo motor 106. Thus, the engine can provide very good performance under a wide variety of speeds and loads due to the use of the variable valve actuating mechanism and the control valve 105.

The foregoing example is only one type of strategy that can be employed and the maximum lift for the valves 37-1 and 37-2 can be either the same or different depending upon the particular engine and tuning arrangement selected, as already noted.

In order to permit a compact assembly, obviously the adjusting screw 65 must be configured in relation to the cam lobes and specifically the cam lobe 45, so as to not present any interference.

Figure 15:
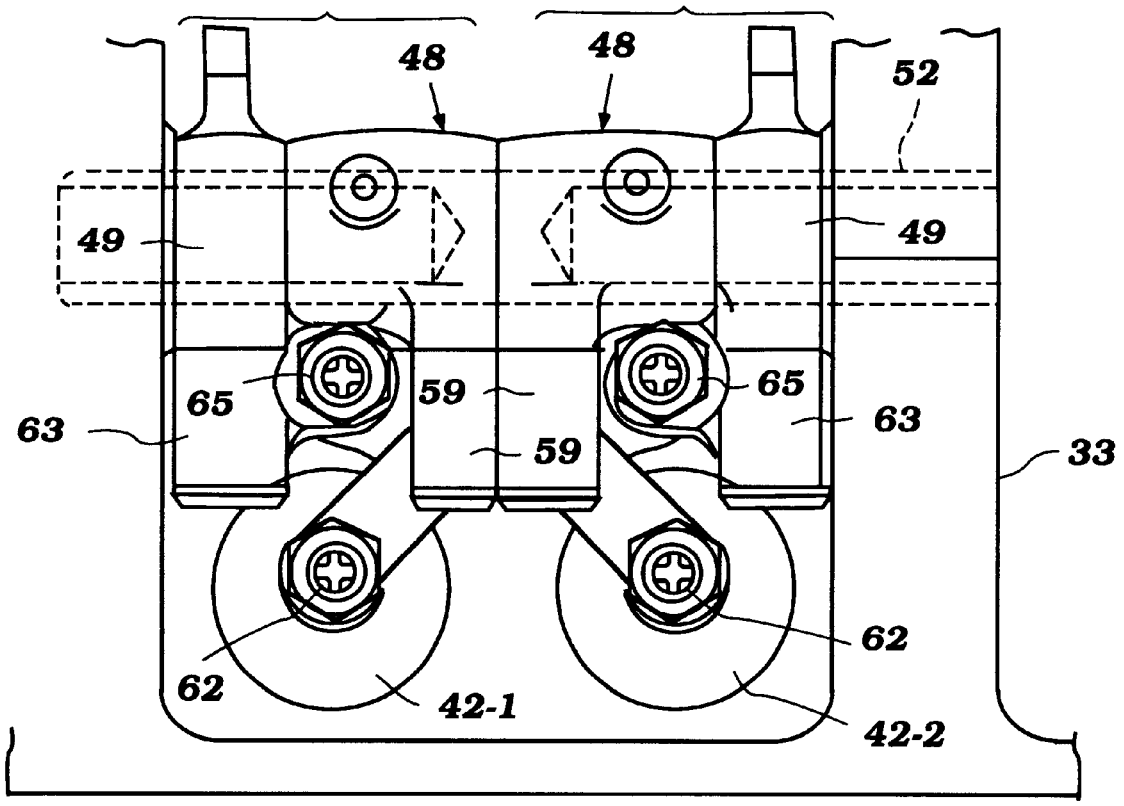
FIG. 15 is a view, in part similar to FIG. 1, and shows another embodiment of the invention where both valves of the same cylinder are operated by variable valve actuating mechanisms.
Figure 16:
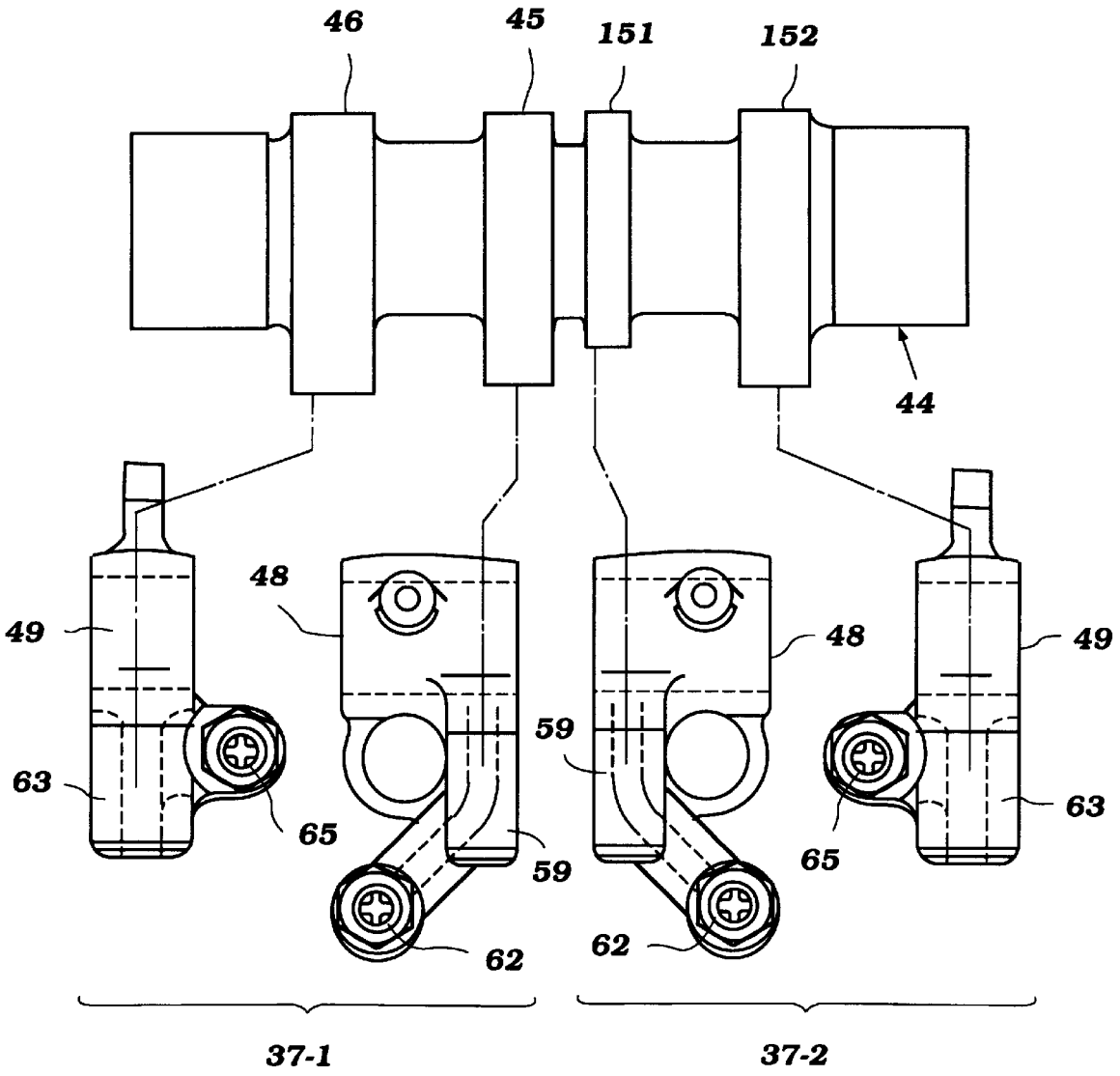
FIG. 16 is a partially exploded view, in part similar to FIG. 2, but shows the cam shaft and rocker arms of this embodiment.

FIGS. 15 and 16 show another embodiment of the invention wherein both of the intake valves 37-1 and 37-2 are provided with a variable valve actuating mechanism. In this particular embodiment, the cam shaft is provided with, in addition to, the lobes 45 and 46, for actuating the first intake valve 37-1, with additional lobes 151 and 152 for operating the rocker arms 48 and 49 associated with the remaining valve 37-2.

It should be noted that the rocker arms 48 and 49 associated with the second intake valve 37-2 are mirror images so as to permit the two rocker arms 48 to be positioned next to each other and the other two rocker arms to be spaced more widely. With this type of arrangement, as shown, the initial lift for the valve 37-2 is less than that of the valve 37-1 but the maximum lift provided by the cam lobes 46 and 152 can be the same.

Figure 17:
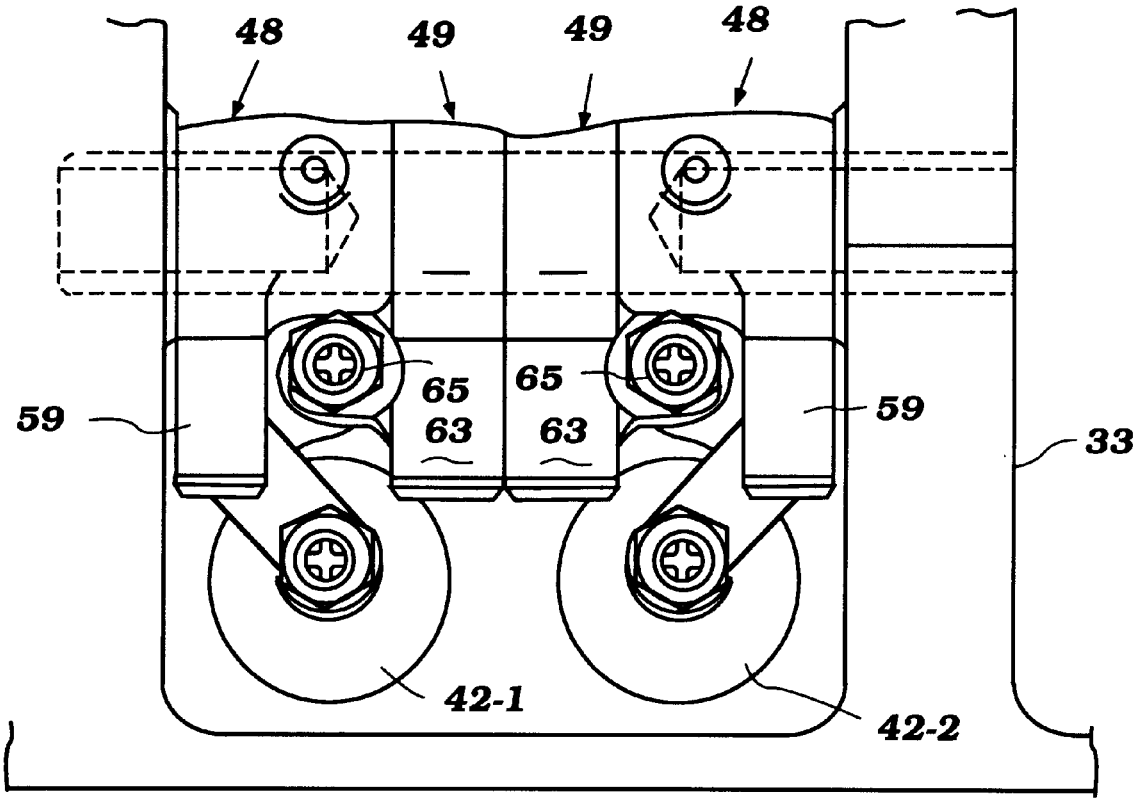
FIG. 17 is a top plan view, in part similar to FIGS. 1 and 15, and shows yet another embodiment of mechanism employing variable valve actuating mechanism for both valves associated with a single cylinder of the engine.
Figure 18:
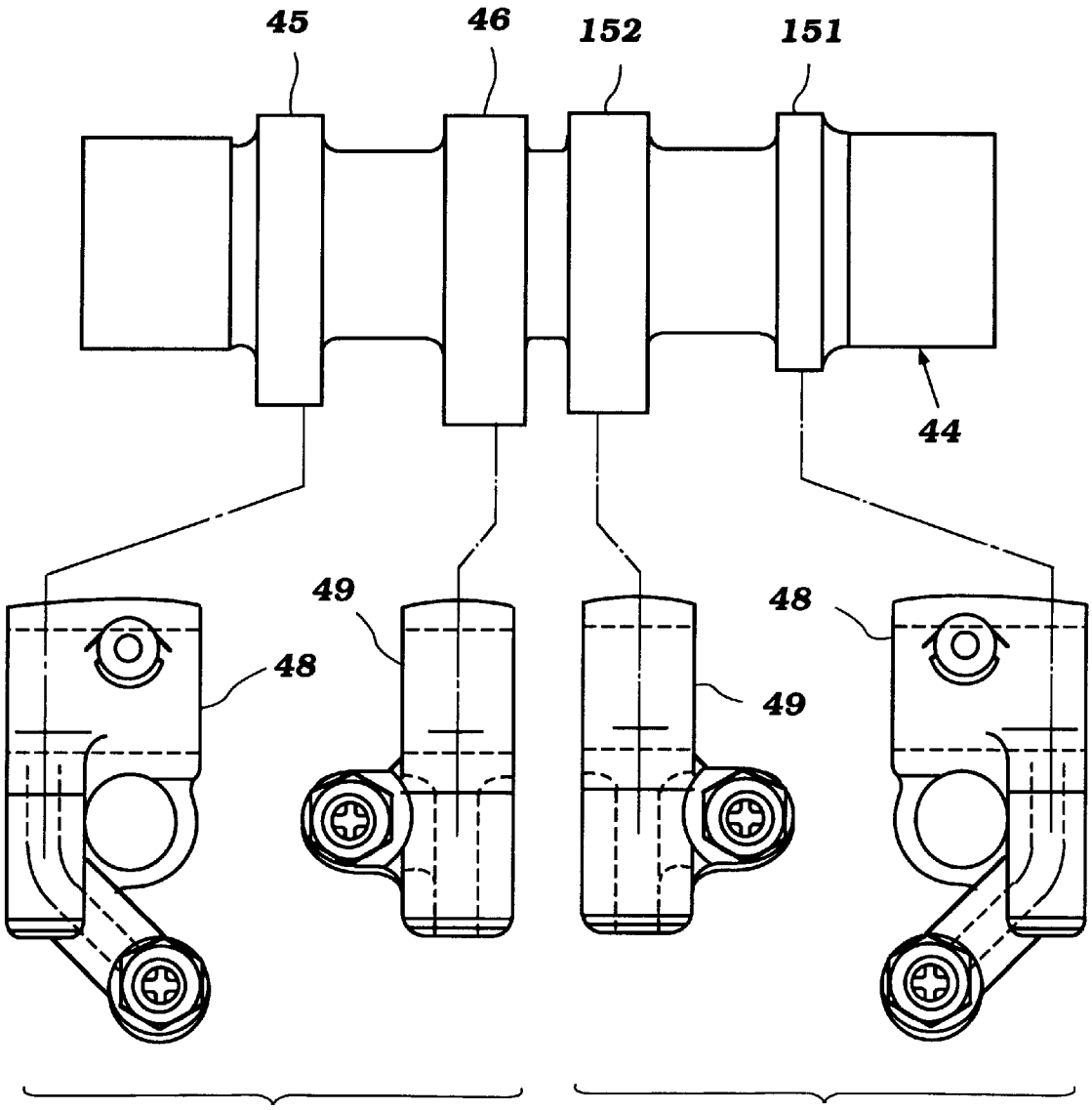
FIG. 18 is an exploded view, in part similar to FIGS. 2 and 16, but shows the cam shaft and rocker arms for this embodiment.

FIGS. 17 and 18 show yet another embodiment. In this embodiment, the rocker arms are reversed from the position utilized in FIGS. 15 and 16. That is, the direct actuating rocker arms 48 are disposed outwardly of the indirect acting rocker arms 49. Again, varying lift arrangements may be employed. As illustrated in this embodiment, the initial lift of the valve 37-1 is substantially greater than that of the remaining valve 37-2 while the maximum lift also is larger but only slightly larger as indicated by the respective cam lobe portions.

Figure 19:
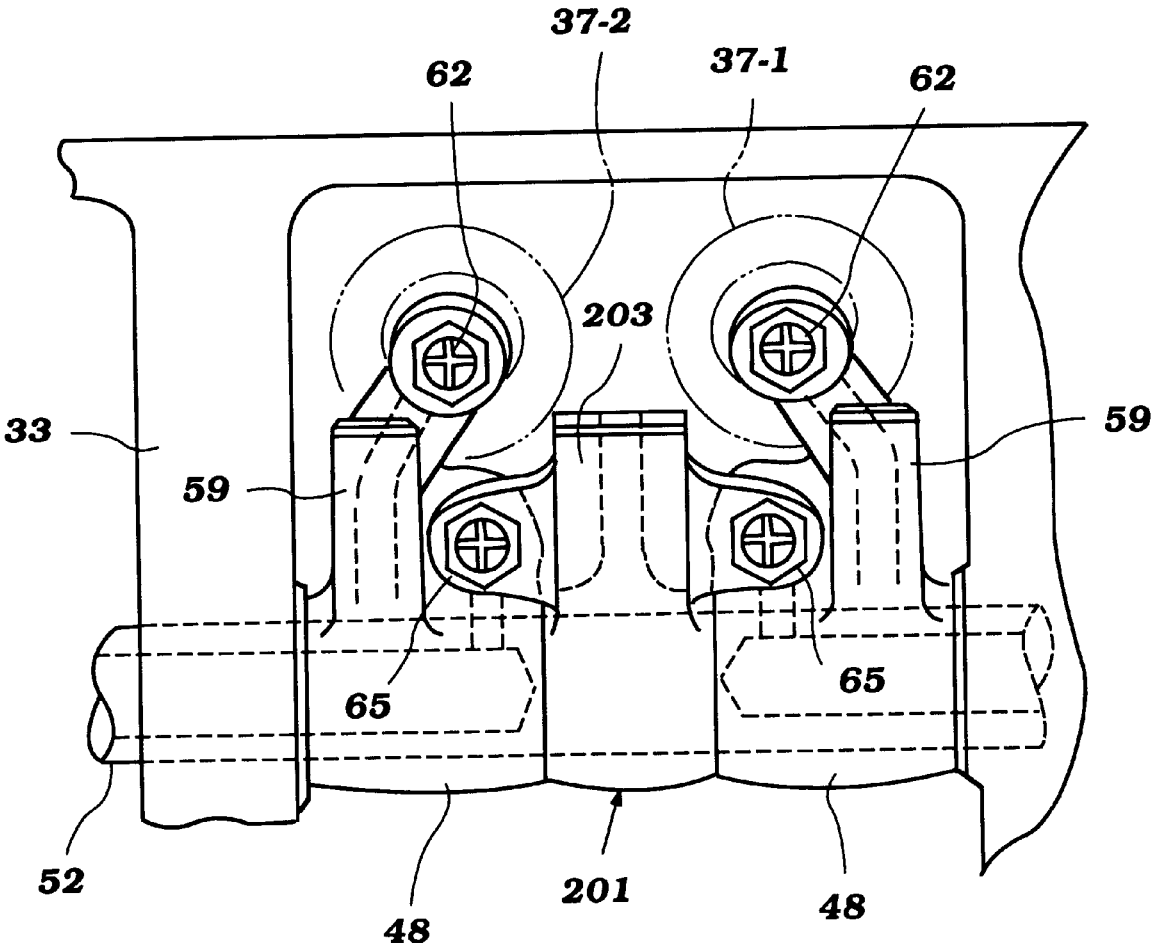
FIG. 19 is a top plan view, in part similar to FIGS. 1, 15 and 17, and shows yet another embodiment of the invention wherein both valves associated with the same cylinder has a variable valve actuating mechanism but, in this embodiment, sharing one of the rocker arms.
Figure 20:
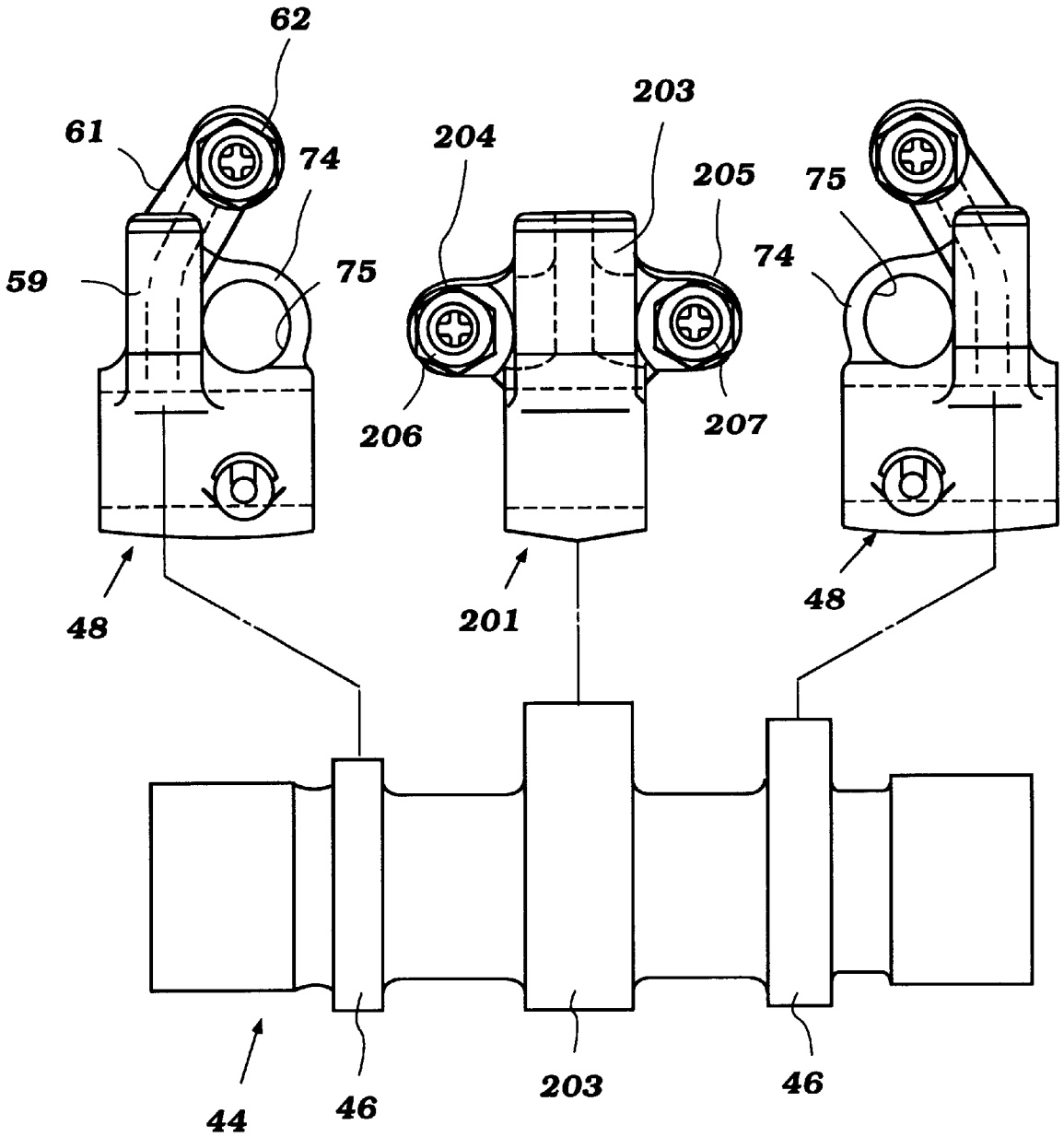
FIG. 20 is an exploded view, in part similar to FIGS. 2, 16 and 18, showing the cam shaft and rocker arm of this embodiment.

In all of the embodiments thus far described, those valves that have had adjustable valve actuation have had associated with them their own first and second rocker arms and first and second cam lobes. FIGS. 19 and 20 show another embodiment wherein the second rocker arms for the two valves are integrated into a single rocker arm. Since that is the only difference between this embodiment and that shown in FIGS. 17 and 18, components which are the same are identified by the same reference numerals and will not be described again, except insofar as is necessary to understand the construction and operation of this embodiment.

In this embodiment, a single second rocker arm 201 for each of the valves 37-1 and 37-2 is provided. This rocker arm 201 has a single follower surface 202 that is engaged by a single cam lobe 203. This rocker arm has a pair of bosses 204 and 205 each of which carries a respective adjusting screw 206 and 207. These adjusting screws actuate the connecting system of the adjacent rocker arm 48, in the manner that has already been described. Thus, with this construction, the arrangement can be further simplified. However, the operation of the second rocker arm 203 on each valve then must be the same. Different lift characteristics can be provided for the operation of the valves 37-1 and 37-2 and in this embodiment the lift of 37-1 is greater than that of 37-2 before the rocker arm 201 actuates both valves.

Figure 21:
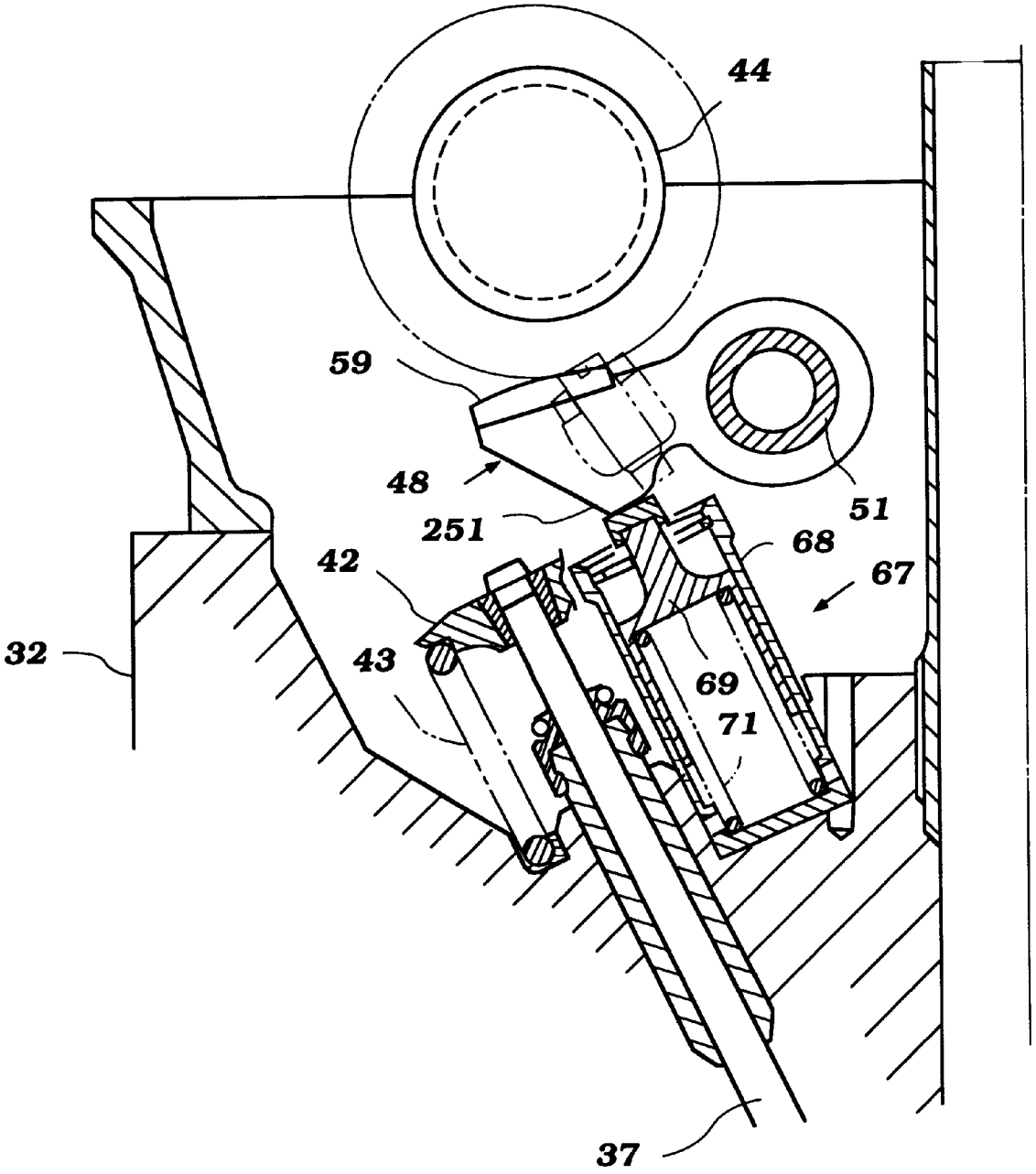
FIG. 21 is a cross-sectional view, in part similar to FIG. 3, but shows another type of biasing arrangement for the second rocker arm.
Figure 22:
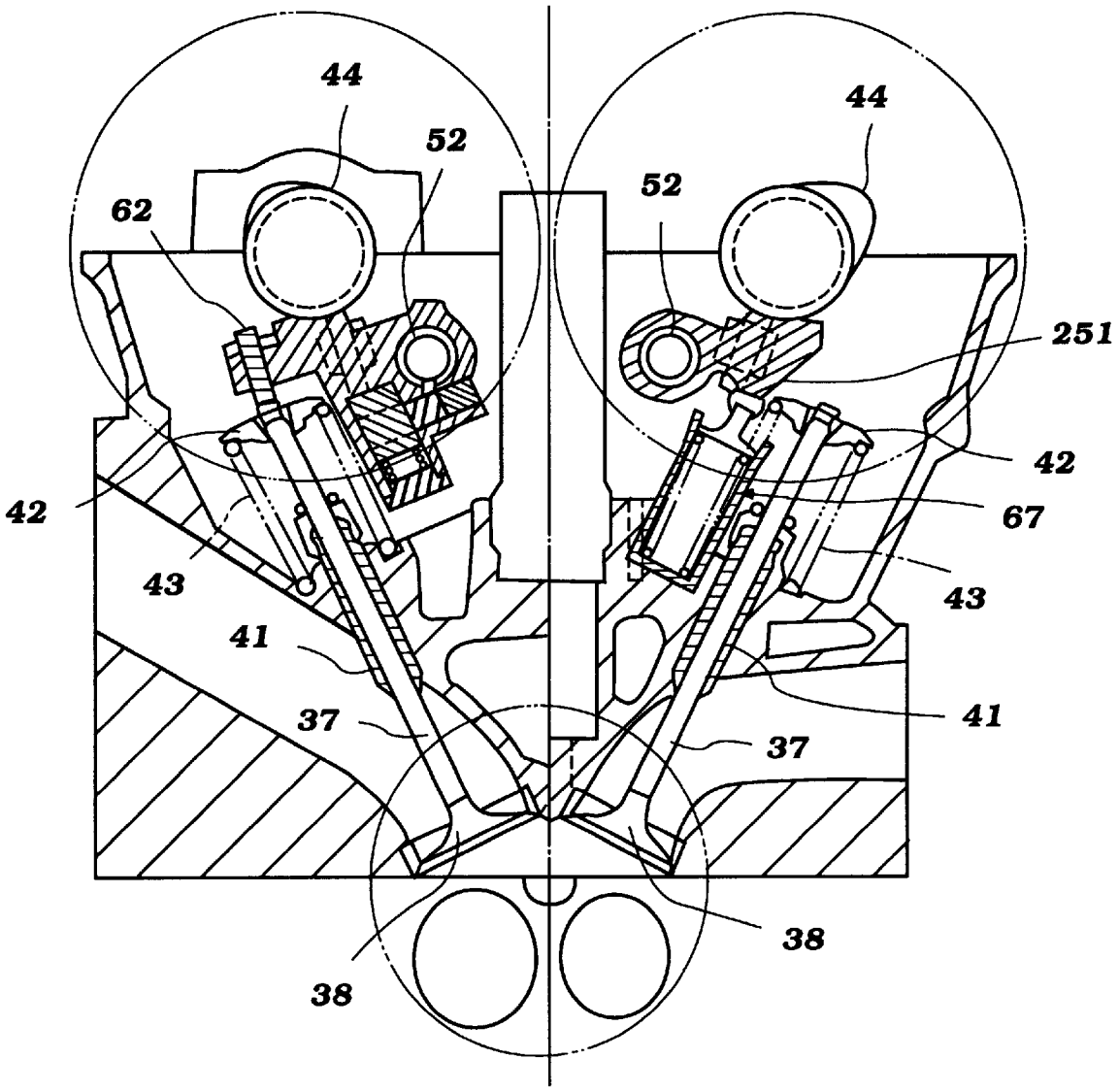
FIG. 22 is a cross-sectional view taken through a cylinder head that utilizes a return arrangement for the second rocker arm as shown in FIG. 21, with the associated cylinder bore and remaining valves shown in phantom line.

FIGS. 21 and 22 show both the incorporation of the variable valve actuating mechanism for all valves of the engine and also shows a different biassing arrangement for the second rocker arms. Since this is the only main difference, components which are the same or substantially the same have been identified by the same reference numerals.

In this embodiment, the second rocker arms 48 have, on the opposite side from their follower surfaces 59, a protruding portion 251 that is engaged by a spring return mechanism which is in essence the same as that employed in and shown in detail in FIG. 3. However, this return mechanism 67 is mounted directly in the cylinder head member 32 rather than on the cam carrier 33. In all other regards, this embodiment is the same and thus, further description of it is not believed to be necessary to permit those skilled in the art to practice the invention.

From the foregoing description, it should be readily apparent to those skilled in the art that the various embodiments disclosed provide a very effective and compact arrangement for achieving variable valve actuation.

We claim:

1. A valve operating mechanism for operating a single poppet valve of an engine through cooperation with the stem thereof, said valve operating mechanism being comprised of a single cam shaft having a pair of adjacent cams, a pair of adjacent pivotally supported rocker arms, each of said rocker arms being operated by a respective one of said cams, a first of said rocker arms having an operating portion for direct engagement with the valve stem for operating the valve directly, and means for selectively coupling the second of said rocker arms to said first rocker arm for effecting actuation of the valve therefrom through said first rocker arm by the cam associated with said second rocker arm comprising actuating means carried by said second rocker arm and engageable with coupling means carried by said first rocker arm for actuating said first rocker arm, said coupling means comprising a plunger slidably supported within a bore formed in said fist rocker arm, said plunger being engaged by said actuating means of said second rocker arm, and a pin slidably supported in said first rocker arm and engageable with a bore formed in said plunger for locking said plunger against sliding movement in said bore.

2. A valve operating mechanism as set forth in claim 1, wherein the first and second cams and first and second rocker arms provide a different lift for the actuated valve.

3. A valve operating mechanism as set forth in claim 2, wherein the lift provided by the second cam and second rocker arm is greater than that provided by the first cam and the first rocker arm.

4. A valve operating mechanism as set forth in claim 1, wherein both of the rocker arms are journaled on the same rocker arm shaft.

5. A valve operating mechanism as set forth in claim 4, wherein the first and second cams and first and second rocker arms provide a different lift for the actuated valve.

6. A valve operating mechanism as set forth in claim 5, wherein the lift provided by the second cam and second rocker arm is greater than that provided by the first cam and the first rocker arm.

7. A valve operating mechanism as set forth in claim 4, wherein the valve has a spring that is associated with it for maintaining the first rocker arm in engagement with the first cam and further including a separate biasing spring for urging the second rocker arm into engagement with the second cam.

8. A valve operating mechanism as set forth in claim 7, wherein the second spring is engaged with an arm of the second rocker arm that is spaced from its actuating portion and which spring bears against an engine body.

9. A valve operating mechanism as set forth in claim 1, wherein there is provided a second poppet valve for serving the same combustion chamber of the engine and wherein the second poppet valve is adjacent the first mentioned poppet valve.

10. A valve operating mechanism as set forth in claim 9, wherein both poppet valves communicate with the combustion chamber.

11. A valve operating mechanism as set forth in claim 10, wherein the second poppet valve is operated by a third cam through a third rocker arm.

12. A valve operating mechanism as set forth in claim 11, wherein all of the rocker arms are supported on the same rocker arm shaft.

13. A valve operating mechanism as set forth in claim 12, the valves are both intake valves.

14. A valve operating mechanism as set forth in claim 13, wherein the first valve is operated with a low lift by the first cam and the first rocker arm and a higher lift by the second cam and the second rocker arm acting through the first rocker arm and wherein the third cam and the third rocker arm provide a lift for the second valve that is higher than that of the first cam and the first rocker arm on the first valve.

15. A valve operating mechanism as set forth in claim 14, wherein separate intake passages serve the intake valves and further including a control valve in the intake passage serving the second valve controlled in response to engine running conditions and opened under only high speed, high load conditions.

16. A valve operating mechanism as set forth in claim 9, wherein the second valve is operated by first and second rocker arms each cooperating with a respective cam lobe to provide a different lift and further including means for selectively coupling the first and second rocker arms associated with the second valve with each other for varying the lift of the second valve.

17. A valve operating mechanism as set forth in claim 16, wherein the first rocker arms for the two valves are disposed adjacent each other on the rocker arm shaft.

18. A valve operating mechanism as set forth in claim 17, wherein the lift provided by the first cam and first rocker arm of one of the valves is different from that provided by the first cam and first rocker arm of the other valve.

19. A valve operating mechanism as set forth in claim 16, wherein the second rocker arms are disposed adjacent each other on the same rocker arm shaft.

20. A valve operating mechanism as set forth in claim 19, wherein the lift provided by the first cam and first rocker arm of one of the valves is different from that provided by the first cam and first rocker arm of the other valve.

21. A valve operating mechanism as set forth in claim 16, wherein one of the rocker arms for each of the valves is a common rocker arm that is capable of actuating both of the valves.

22. A valve operating mechanism as set forth in claim 21, wherein the one rocker arm is the second rocker arm.

23. A valve operating mechanism as set forth in claim 22, wherein the one rocker arm cooperates with a single second cam.

24. A valve operating mechanism as set forth in claim 1, wherein the pin is hydraulically operated.

25. A valve operating mechanism as set forth in claim 24, wherein both of the rocker arms are journaled on the same rocker arm shaft.

26. A valve operating mechanism as set forth in claim 25, the rocker arm shaft is hollow and the hydraulic pressure is transmitted through the rocker arm shaft.

* * * * *

UNITED STATES PATENT AND TRADEMARK OFFICE

CERTIFICATE OF CORRECTION

PATENT NO. : 5,924,396

DATED : July 20, 1999

INVENTOR(S) : Ochiai, et al

It is certified that error appears in the above-identified patent and that said Letters Patent is hereby corrected as shown below:

On the title page, under item [30] Foreign Priority Data", please delete October 7, 1997" and insert -- October 7, 1996 --.

Signed and Sealed this

Seventh Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,924,396
DATED : July 20, 1999
INVENTOR(S) : Ochiai et al.

It is certified that error appears in the above-identified patent and that said Letters Patent is hereby corrected as shown below:

Column 7, claim 1,
Line 65, please delete -- fist rocker -- and replace with -- first rocker --

Signed and Sealed this

Eleventh Day of December, 2001

*Attest:*

Nicholas P. Godici

NICHOLAS P. GODICI
*Acting Director of the United States Patent and Trademark Office*

*Attesting Officer*